US006729508B1

(12) United States Patent
Klimpert et al.

(10) Patent No.: US 6,729,508 B1
(45) Date of Patent: May 4, 2004

(54) MECHANICAL BEADING SYSTEM

(75) Inventors: Randall Jon Klimpert, Wilmette, IL (US); Dianne Lauble, Chicago, IL (US)

(73) Assignee: Meyer/Glass Design, Ltd., Chicago, IL (US)

( * ) Notice: Subject to any disclaimer, the term of this patent is extended or adjusted under 35 U.S.C. 154(b) by 0 days.

(21) Appl. No.: 10/352,541

(22) Filed: Jan. 29, 2003

(51) Int. Cl.[7] ..... A41H 43/00
(52) U.S. Cl. ..... 223/48; 29/241
(58) Field of Search ..... 223/48, 102, 104; 29/241; 294/1.1; 414/921; 63/37, 38, 39

(56) References Cited

U.S. PATENT DOCUMENTS 5,197,175 A * 3/1993 Yuen ..... 29/241

* cited by examiner

*Primary Examiner*—John J. Calvert
*Assistant Examiner*—James G Smith
(74) *Attorney, Agent, or Firm*—Marc J. Whipple

(57) ABSTRACT

A mechanical beading system is disclosed. Specifically, the beading system rotates a stiff but flexible beading wire inside an appropriately-shaped container of beads, causing them to slide onto the open end of the beading wire. The beading wire engages the beading mechanism with an endpiece which also allows the beading wire to be removeably fixed in place to complete the work.

10 Claims, 1 Drawing Sheet

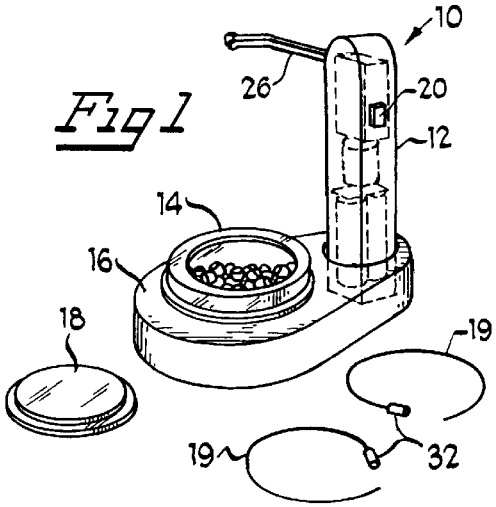
Fig 1
10
26
20
12
14
16
18
19
19
32
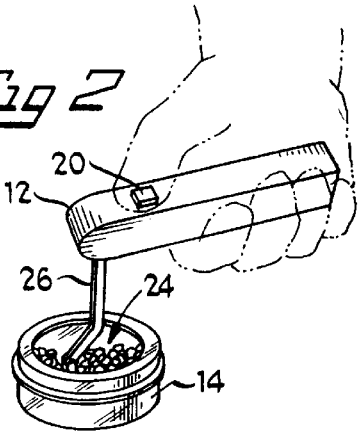
Fig 2
20
12
26
24
14
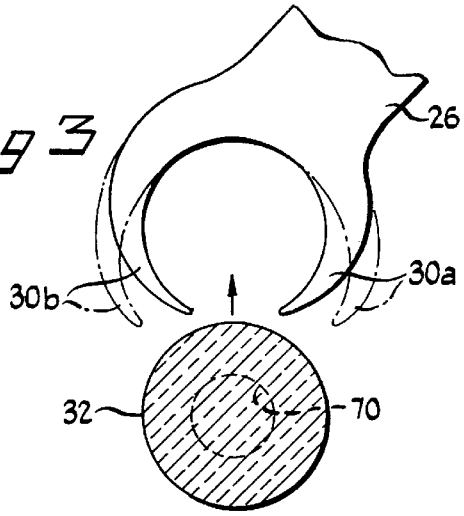
Fig 3
26
30b
30a
32
70
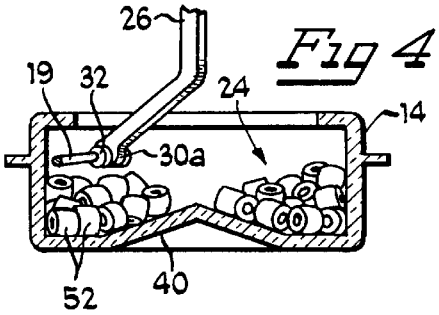
Fig 4
26
19
32
24
14
30a
52
40
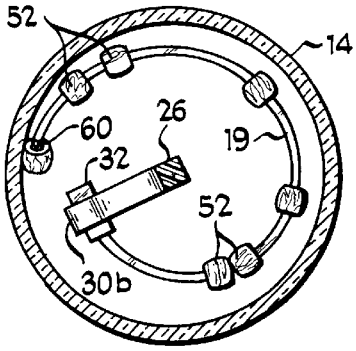
Fig 5
52
14
60
26
19
32
52
30b
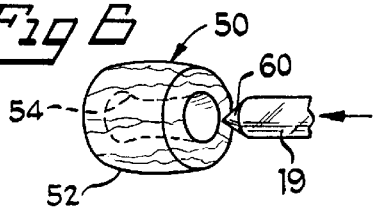
Fig 6
50
60
54
52
19
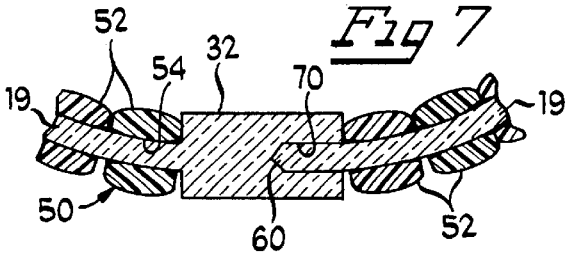
Fig 7
52
54
32
70
19
19
50
60
52
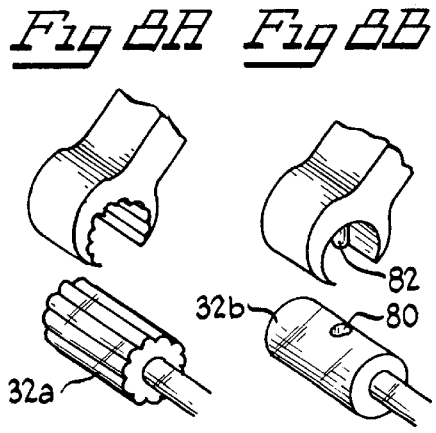
Fig 8A
Fig 8B
82
32b
80
32a

MECHANICAL BEADING SYSTEM

BACKGROUND OF THE INVENTION

Although the invention is suitable for a wide variety of applications, the description of the preferred embodiment uses it in a beading activity for children. Beading activities are a well-known crafting application in the art of crafts and activities for children. Traditionally, beads with a hole bored either on an axis or an appropriate line are put on a wire or string to create a beaded product. For older children, the string or wire can be put through the eye of a needle to aid in the stringing of the beads.

While this approach works, it would be advantageous to have a more automated mechanical system which would allow the beading to proceed much more quickly. Furthermore, it would be desirable to have a mechanical aid to beading-that a younger child could easily operate. It would also be desirable to have a mechanical beading system which incorporated a simple means of completing the beaded work. The present invention addresses these concerns.

OBJECTS OF THE INVENTION

An object of the invention is to provide a mechanical beading system which produces beaded works quickly and easily.

A second object of the invention is to provide a mechanical beading system which is easy and safe for young children to use.

A third object of the invention is to provide a mechanical beading system which incorporates a simple means of completing beaded works.

Other objects and advantages of the invention will become apparent in the following disclosure.

SUMMARY OF THE INVENTION

The present invention relates to a mechanical system of stringing beads on a wire quickly and easily. A stiff but flexible wire is circulated through a container with appropriate beads: beads are gradually slipped onto the wire as it circulates. When the wire contains the desired number of beads, it is removed from the circulating mechanism and closed to retain the beads. A thickened section of the wire also serves as an integral reuseable closure mechanism.

BRIEF DESCRIPTION OF THE DRAWINGS

The characteristic features of the invention will be particularly pointed out in the claims. The descriptions of the preferred embodiment refer to the preceding drawings:

FIG. 1 is a representational view of the entire apparatus.

FIG. 2 is a representational view of the beading mechanism in operation.

FIG. 3 is a cross-sectional view of the bead wire receiving means.

FIG. 4 is a cross-sectional view of the bead wire in operation.

FIG. 5 is an overhead view of the bead wire in operation.

FIG. 6 is a. representational view of the bead wire engaging a bead.

FIG. 7 is a cross-sectional view of the bead wire in the final configuration FIG. 8A is a representational view of an alternate embodiment of the bead wire receiving means.

FIG. 8B is a representational view of an alternate embodiment of the bead wire receiving means.

DESCRIPTION OF THE PREFERRED EMBODIMENT

The description of the preferred embodiment uses the invention in a device which makes beaded bracelets. With slight modifications, the end product could be modified to produce such things as necklaces, decorations, items for dolls, or components for more complex constructions.

By referring to FIGS. 1 and 2, the basic concept of the invention may be easily understood. The apparatus 10 consists of base unit 16, which holds receptacle 14, which contains beads 52 (not shown: see FIG. 4) and hand unit 12. Also shown are beading wires 19 and receptacle lid 18. It is preferred, but not required, that beading wires 19 are of a size that will fit approximately around hand unit 12 or else within receptacle 14: this allows convenient storage when the apparatus is not in use.

To operate the apparatus, the user first places a beading wire 19 on rotary arm 26. (See FIG. 3 and alternate FIGS. 8A, 8B for the means by which endpiece 32 engages rotary arm 26.) Hand unit 12 is then held so as to place beading wire 19 within receptacle 14 and switch 20 is engaged. This causes a motor (not shown—see FIG. 1) inside hand unit 12 to begin to 20 rotate rotary arm 26 with a circular motion. Rotary arm 26 in turn rotates beading wire 19 inside receptacle 14. The result of this operation is described below.

FIG. 3 details the removeable affixment of endpiece 32 to rotary arm 26. Rotary arm 26 ends in claws 30*a* and 30*b*. Rotary arm 26 and claws 30*a* and 30*b*. are formed of one piece of any desired material, preferably a rigid molded plastic. In this embodiment it is required that the material have some elasticity which will allow endpiece 32 to be forced into claws 30*a* and 30*b* and then cause it to be held there by friction. (Alternate embodiments can be seen in FIGS. 8*a*, 8*b*.) It is preferable to chose the material and configuration of claws 30*a* and 30*b* such that endpiece 32 can be forced into the gap between claws 30*a* and 30*b* with a positive "snap," adjusting the tension for the predicted strength and dexterity of the target user.

FIG. 4 shows the operation of rotary arm 26 in receptacle 14. Rotary arm 26 is rotating such that beading wire 19 describes a circle somewhat smaller than, and in the same plane as, receptacle 14. Receptacle 14 contains a plurality of beads 52. The user lowers hand unit 12 (not shown, see FIG. 2) until beading wire 19 enters beads 52. The result is described below. It is preferred that receptacle 14 be formed as shown, specifically that it have a slight "lip" on the upper outer circumference such that beads cannot be pushed out by the action of the apparatus, and that it have a slight elevation in the center such that beads will tend to accumulate on the lower outer circumference. Both of these characteristics increase the efficiency of the beading process.

FIG. 5 shows the actual beading process. Beading wire 19, held to rotary arm 26 by the grip of claws 30*a* and 30*b* on endpiece 32, is rotating through beads 52. The forward end 60 (not shown, see FIG. 6) of beading wire 19 will encounter the holes 54 (not shown, see FIG. 6) in beads 52 from time to time. When this occurs, beading wire 19 will pass through the hole, stringing the bead. As beading wire 19 continues to rotate, the pressure from beads 52 generally will cause strung beads to move further up beading wire 19. When beading wire 19 is full, or at any time when the quantity of strung beads is deemed sufficient by the user, hand unit 12 (see FIG. 2) is lifted, switch 20 is disengaged, and the user may complete the beading process by closing beading wire 19 (see detail in FIG. 7.)

FIG. 6 shows forward end of beading wire 19 entering the hole 54 of a bead 52. It is preferred, but not required that forward end be shaped as shown, or in some other fashion gradually narrowed towards its end, to facilitate its entry into the beads. It is likewise preferred, but not required, that hole 54 be flared or otherwise open as much as possible at the surface of the bead to facilitate the entry of forward end 60.

FIG. 7 shows the finished product. Beading wire 19, being strung as desired with beads 52, has forward end 60 inserted-into receiver 70 of endpiece 32. In this embodiment, it is required that receiver 70 be sufficiently close in size to forward end that friction will hold beading wire 19 closed. Judicious selection of the materials and respective sizes will then allow beading wire 19 to be removed from endpiece 32, permitting beads 54 to be removed and the process to be repeated as desired. Alternate embodiments using adhesives or mechanical fastening systems, which may be permanent or reusable, are also possible. In this embodiment, endpiece 32 and beading wire 19, including forward end 60, are formed of a single piece of molded material, but this is not required. Endpiece 32 may be added to beading wire 19 in a later manufacturing step or even by the user prior to the beading process.

FIG. 8A shows an alternate embodiment of rotary arm 26 and endpiece 32*a*. Here, endpiece 32*a* is formed so as to enter into a mechanical alignment with rotary arm 26. This will provide less freedom of movement and greater security of endpiece 32*a*, if desired, and could be used to make it easier for a child to insert endpiece 32*a* into the rotary arm. The effect is also decorative with regards to endpiece 32*a*.

FIG. 8B shows an alternate embodiment of rotary arm 26 and endpiece 32*b*. Here, endpiece 32*b* further comprises locator 80 which mates with locator peg 82. This will provide less freedom of movement and greater security of endpiece 32*b*, if desired, and could be used to make it easier for a child to insert endpiece 32*b* into the rotary arm. It will also allow a much greater tolerance for the frictional fit of endpiece 32*b*, which will not be able to slide or rotate on rotary arm 26 even while rotating through beads.

While the description above details the preferred and best mode(s) of practicing the invention, many other configurations and variations are possible. For example:

1) The invention need not be practiced as a means of making jewelry for human beings, but could be a simulated piece of construction equipment, a method of making decorations for dolls or inanimate objects, or a means for making independent works of art.
2) The mechanism need not be actuated by a battery-powered motor, but could be powered by a human-wound spring or even by a direct or gear-driven mechanism powered by the user.

Accordingly, the scope of the invention should be determined not by the embodiment(s) illustrated, but by the claims below and their equivalents.

What is claimed is:

1. A mechanical beading system comprising:

A) A container;

B) A plurality of beads located within the container;

C) A beading wire having a bead-collecting end and an opposite end;

D) A rotating arm to which the beading wire can be removably affixed; and,

E) A control unit to which the rotating arm is operably affixed, such that the beading wire can be introduced into the container by means of the control unit in such a manner that the bead-collecting end will rotate through the plurality of beads.

2. A mechanical beading system as in claim 1, further comprising:

F) An endpiece, affixed to the opposite end of the beading wire, to which the bead-collecting end can be affixed, causing the beading wire to form a continuous piece.

3. A mechanical beading system as in claim 1, further comprising:

F) An endpiece, affixed to the opposite end of the beading wire, to which the bead-collecting end can be removably affixed, causing the beading wire to form a continuous piece.

4. A mechanical beading system as in claim 1 wherein the opposite end of the beading wire has a receptacle into which the bead-collecting end can be inserted, forming a continuous piece.

5. A mechanical beading system as in claim 1 wherein the opposite end of the beading wire has a receptacle into which the bead-collecting end can be removably inserted, forming a continuous piece.

6. A mechanical beading system as in claim 2, wherein the endpiece and the beading wire are formed of a single piece of a molded material.

7. A mechanical beading system as in claim 3, wherein the endpiece and the beading wire are formed of a single piece of a molded material.

8. A mechanical beading system as in claim 1, wherein the control unit contains an electrical motor which is operably attached to the rotating arm and causes the rotating arm to rotate when a switch in the control unit is actuated.

9. A mechanical beading system as in claim 1, wherein the control unit contains a hand-operated gear train which is operably attached to the rotating arm and causes the rotating arm to rotate when a user rotates a crank attached to the gear train.

10. A mechanical beading system as in claim 1, wherein the control unit contains a spring-driven motor which is operably attached to the rotating arm and causes the rotating arm to rotate when a user winds the spring-driven motor.

* * * * *